US011415132B2

(12) United States Patent
Jo et al.

(10) Patent No.: US 11,415,132 B2
(45) Date of Patent: Aug. 16, 2022

(54) SCROLL COMPRESSOR CONTAINING SCROLL SELF-ROTATION PREVENTION ARRANGEMENT

(71) Applicant: LG ELECTRONICS INC., Seoul (KR)

(72) Inventors: Changeol Jo, Seoul (KR); Suchul Kim, Seoul (KR); Ikhyeon Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 192 days.

(21) Appl. No.: 16/876,281

(22) Filed: May 18, 2020

(65) Prior Publication Data

US 2020/0400144 A1 Dec. 24, 2020

(30) Foreign Application Priority Data

Jun. 19, 2019 (KR) ..... 10-2019-0072931

(51) Int. Cl.

| | |
|---|---|
| ***F01C 1/02*** | (2006.01) |
| ***F04C 27/00*** | (2006.01) |
| ***F04C 18/02*** | (2006.01) |
| ***F01C 17/06*** | (2006.01) |
| ***F04C 23/00*** | (2006.01) |

(52) U.S. Cl.

CPC ..... *F04C 18/0253* (2013.01); *F01C 1/0246* (2013.01); *F01C 1/0253* (2013.01); *F01C 17/066* (2013.01); *F04C 18/0215* (2013.01); *F04C 18/0246* (2013.01); *F04C 27/001* (2013.01); *F04C 23/008* (2013.01)

(58) Field of Classification Search

CPC ..... F04C 18/0215; F04C 18/0246; F04C 18/0253; F04C 27/001; F04C 23/008; F01C 1/0253; F01C 1/0246; F01C 17/066

See application file for complete search history.

(56) References Cited

U.S. PATENT DOCUMENTS

| | | | | |
|---|---|---|---|---|
| 6,695,599 | B2 * | 2/2004 | Uchida | F04C 27/005 418/55.4 |
| 2001/0048886 | A1 * | 12/2001 | Kuroki | F04C 27/005 418/55.4 |
| 2018/0087508 | A1 * | 3/2018 | Tsu | F04C 29/12 |

FOREIGN PATENT DOCUMENTS

| | | | | |
|---|---|---|---|---|
| GB | 2352274 | A * | 1/2001 | F04C 27/005 |
| JP | H11-241691 | | 9/1999 | |
| KR | 20020067729 | A * | 8/2002 | |
| KR | 10-0654122 | | 12/2006 | |
| KR | 10-2014-0136797 | | 12/2014 | |

OTHER PUBLICATIONS

English Machine Translation of JPH1241691 (Year: 1999).*

(Continued)

*Primary Examiner* — Dominick L Plakkoottam
*Assistant Examiner* — Paul W Thiede
(74) *Attorney, Agent, or Firm* — Ked & Associates LLP

(57) ABSTRACT

A scroll compressor is provided in which one of a fixed scroll or an orbiting scroll is provided with at least one guide groove, and the other is provided with a self-rotation prevention member inserted into the at least one guide groove to revolve in the at least one guide groove and configured to prevent self-rotation of the orbiting scroll.

12 Claims, 12 Drawing Sheets

(56) References Cited

OTHER PUBLICATIONS

English Machine Translation of KR20020067729A (which is corresponding publication KR100417421B1), translated by Espacenet on Jan. 15, 2022. (Year: 2002).*
Derwent English Abstract of KR20020067729A (Year: 2002).*
Korean Office Action dated Aug. 18, 2020 issued in Application No. 10-2019-0072931.

* cited by examiner

SCROLL COMPRESSOR CONTAINING SCROLL SELF-ROTATION PREVENTION ARRANGEMENT

CROSS-REFERENCE TO RELATED APPLICATION(S)

This application claims the benefit of priority under 35 U.S.C. § 119(a) to Korean Patent Application No. 10-2019-0072931, filed in Korea on Jun. 19, 2019, the disclosure of which is incorporated by reference herein in its entirety.

BACKGROUND

1. Field

A compressor, and more specifically, a scroll compressor is disclosed herein.

2. Background

Compressors are devices for compressing fluids, such as refrigerant gases, for example. They may be classified as rotary compressors, reciprocating compressors, and scroll compressors, for example, based on a method of compressing fluids.

Scroll compressors are compressors that include two scrolls. In the scroll compressors, a plurality of compression chambers is formed between the two scrolls while the two scrolls make relative orbital movements, and a volume of the compression chambers is reduced while the compression chambers continue to move to a center. Thus, refrigerant continues to be suctioned, compressed, and discharged.

The scroll compressors may acquire a higher compression ratio than other types of compressors, and may obtain stable torque as suction, compression and discharge processes of refrigerant are smoothly carried out. Accordingly, they may be widely used to compress refrigerant in conditioning apparatuses, for example.

The scroll compressors may be classified as low pressure-type scroll compressors and high pressure-type scroll compressors on the basis of whether a casing is filled with suctioned gases or discharged gases. The low pressure-type scroll compressor may include a motor and a compression portion.

The motor may include a drive motor that includes a rotor and a stator, and a drive shaft that rotates as the drive motor rotates and that is provided with an eccentric portion at an upper portion of the drive shaft. A main frame may be disposed between the motor and the compression portion, and the motor may be provided with a suction pipe for suctioning fluids from the outside.

The compression portion may include an orbiting scroll and a fixed scroll. The fixed scroll is fixed to an upper portion of the main frame, and the orbiting scroll is disposed between the main frame and the fixed scroll. The orbiting scroll may connect with the drive shaft and may orbit by a rotation of the drive shaft, and may compress refrigerant suctioned into the compression portion while being engaged with the fixed scroll and orbiting.

The scroll compressor may include an Oldham's ring for allowing the orbiting scroll to orbit in the fixed scroll as a self-rotation prevention device, and a discharge pipe for discharging refrigerant compressed in the compression portion outwards. The Oldham's ring may be disposed between the main frame and the orbiting scroll, may have a ring-shaped body and may include a key configured to protrude from the body towards the orbiting scroll. The orbiting scroll may include a circular plate-shaped head plate and an orbiting wrap configured to protrude in a thickness-wise direction of the head plate. Additionally, a key groove may be provided at a bottom of the head plate, which faces the Oldham's ring and the main frame. That is, the key groove may be provided on a surface opposite to a surface where the orbiting wrap is disposed, on the head plate.

The key groove may be concave and may be formed at a bottom of the head plate, and the orbiting scroll and the Oldham's ring may be coupled in a way that the key is fitted into the key groove. The key groove may have a length that extends in a radial direction of the head plate such that the key of the Oldham's ring moves in the key groove. The key groove is open outwards in the radial direction of the head plate while passing through the head plate, and the key of the Oldham's ring may come in and out of the key groove through the open passage.

In the scroll compressor, leakage and lubrication between the fixed scroll and the orbiting scroll are important factors. That is, to prevent a leak between the fixed scroll and the orbiting scroll, an end of the wrap and a surface of the head plate have to come into close contact with each other such that compressed refrigerant does not leak. In other words, the head plate of the fixed scroll may come into close contact with the wrap of the orbiting scroll and the head plate of the orbiting scroll may come into close contact with the wrap of the fixed scroll.

Resistance caused by friction has to be minimized such that the orbiting scroll may smoothly make orbital movements with respect to the fixed scroll. The problems of leakage conflicts with the problem of lubrication. That is, when the end of the wrap and the surface of the head plate strongly contact each other, a leak may be prevented while friction is increased. Accordingly, damage caused by noise and wear may be increased. When the end of the wrap and the surface of the head plate contact each other less strongly, friction may be reduced while a sealing force is decreased. Accordingly, leakage may be increased.

Conventionally, a back-pressure chamber having an intermediate pressure, defined as a value between a discharge pressure and a suction pressure, is formed at a back of an orbiting scroll or a fixed scroll to solve the problem of a reduction in sealing force and friction. The back-pressure chamber may communicate with a compression chamber having an intermediate pressure among a plurality of compression chambers formed between the orbiting scroll and the fixed scroll. A pressure applied in the back-pressure chamber may act to bring the orbiting scroll into close contact with the fixed scroll at a proper level, thereby making it possible to solve the problem of leakage and lubrication to some degree.

The back-pressure chamber may be disposed at a bottom of the orbiting scroll or at a top of the fixed scroll. For convenience of description, a back-pressure chamber disposed at the bottom of the orbiting scroll is referred to as a "lower back pressure-type scroll compressor" and a back-pressure chamber disposed at the top of the fixed scroll is referred to as an "upper back pressure-type scroll compressor".

The lower back pressure-type scroll compressor may have a simple structure. In the lower back pressure-type scroll compressor, a bypass hole, for example, may be easily formed. In the lower back pressure-type scroll compressor, a back-pressure chamber may be formed at a bottom of the orbiting scroll, specifically, at a bottom of the head plate.

A key groove as well as the back-pressure chamber may be formed at the bottom of the head plate of the orbiting scroll. In some embodiments, the back-pressure chamber may be formed along a circumference of the head plate, and the key groove may be formed along a radial direction of the head plate.

In a case in which the back-pressure chamber and the key groove are disposed to overlap, the back-pressure chamber may not be formed properly. The back-pressure chamber, which communicates with a compression chamber having an intermediate pressure among the plurality of compression chambers, is hardly disposed out of a specific position, for example, an intermediate point between a center of the head plate in the radial direction thereof and an outer circumferential surface of the head plate.

Accordingly, the key groove has to be disposed between the outer circumferential surface of the head plate and the outer circumferential surface of the head plate. In a case in which the key groove is disposed as described above, as the key groove has to extend in the radial direction of the head plate, the head plate of the orbiting scroll has to be scaled up. Thus, the scroll compressor has to be scaled up.

BRIEF DESCRIPTION OF THE DRAWINGS

Embodiments will be described in detail with reference to the following drawings in which like reference numerals refer to like elements, and wherein.

DETAILED DESCRIPTION

Figure 1:
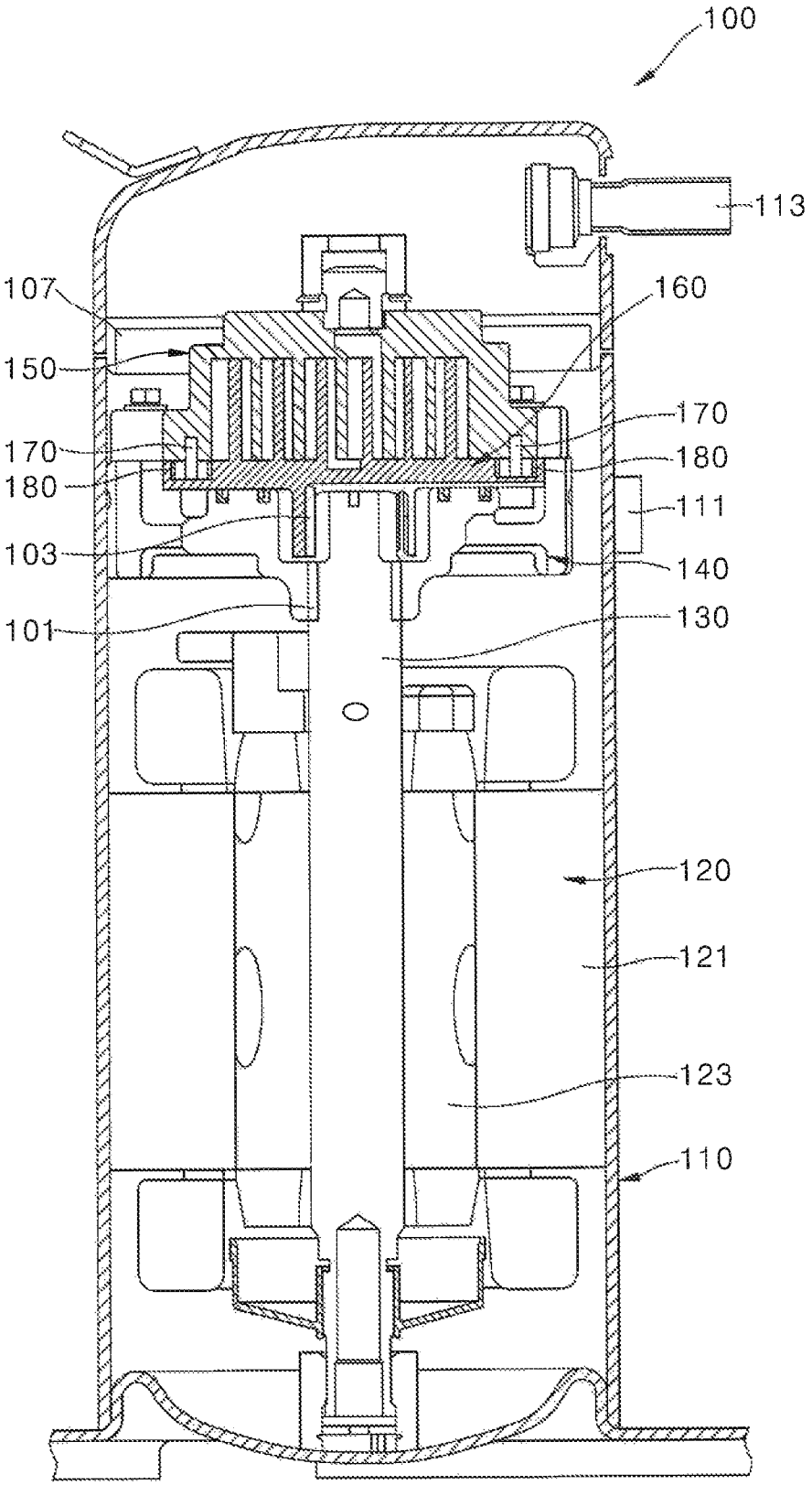
FIG. 1 is a cross-sectional view of a scroll compressor according to an embodiment.

A scroll compressor according to embodiments will be described with reference to the accompanying drawings. A thickness of lines or sizes of components illustrated in the drawings may be exaggerated for the sake of convenience and clarity in description. Further, terms that are described hereinafter are those defined considering functions described and may differ depending on the intention or the practice of the user or operator. Therefore, such terms should be defined on the basis of description throughout the specification.

Figure 2:
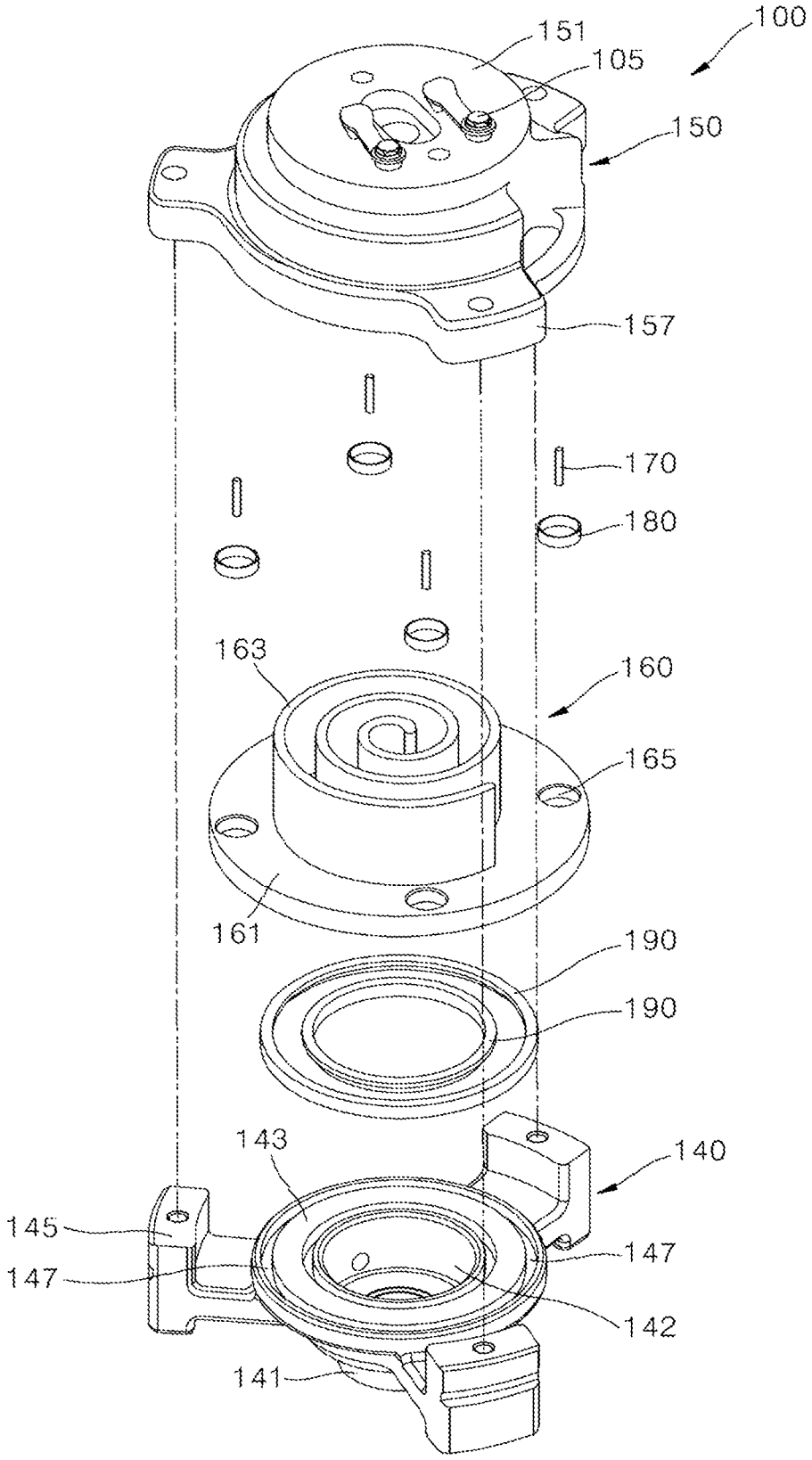
FIG. 2 is a top perspective exploded view of the scroll compressor of FIG. 1.
Figure 3:
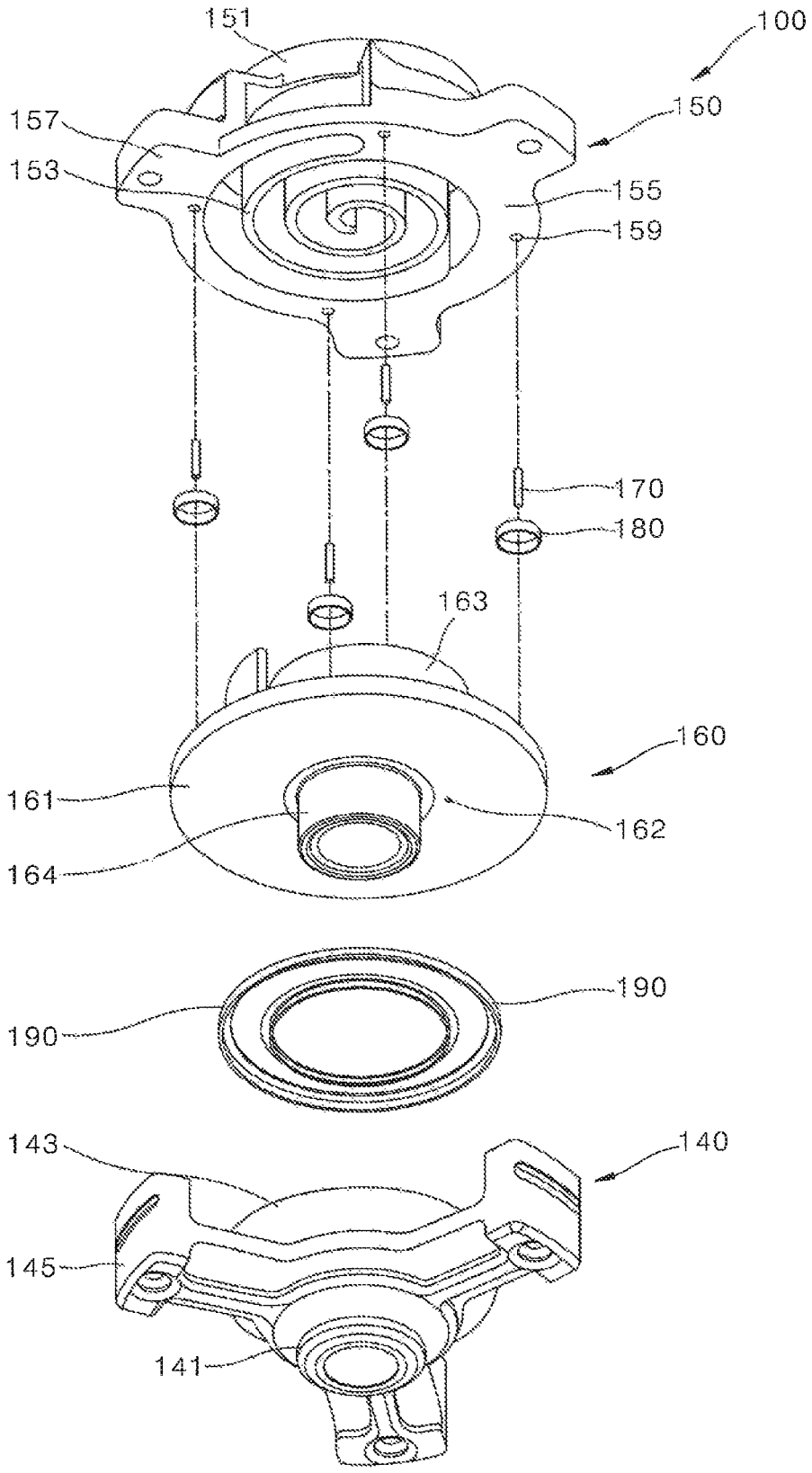
FIG. 3 is a bottom perspective exploded view of the scroll compressor of FIG. 2.

FIG. 1 is a cross-sectional view of a scroll compressor according to an embodiment. FIG. 2 is a top perspective exploded view of the scroll compressor of FIG. 1. FIG. 3 is a bottom perspective exploded view of the scroll compressor of FIG. 2.

Referring to FIGS. 1 to 3, a scroll compressor 100 according to an embodiment may include a casing 110, a motor 120, a drive shaft 130, a main frame 140, a fixed scroll 150, and an orbiting scroll 160. The casing 110 may define an appearance of the scroll compressor 100 according to the embodiment. An inner space that accommodates various components of the scroll compressor 100 may be formed in the casing 110.

The casing 110, for example, may have an approximate cylinder shape. The casing 110 may be provided with an inlet 111 and an outlet 113. The inlet 111 may be a passage formed at the casing 110 to suction refrigerant into the casing 110, and the outlet 113 may be a passage formed at the casing 110 to discharge refrigerant, compressed in the casing 110, out of the casing 110.

The inner space of the casing 110 may be divided into a motor portion where the motor 120 is installed and a compression portion that is a space where refrigerant is compressed. The motor 120 may be accommodated in the inner space of the casing 110, specifically, in the motor portion. The motor 120 may include a stator 121 and a rotor 123. A constant speed motor in which the rotor 123 rotates at constant speed may be used as the motor 120. However, an inverter motor in which a rotational speed of the rotor 123 is variable may also be used as the motor 120.

The drive shaft 130 may be connected to the rotor 123 of the motor 120 and may be rotated by a rotational force generated by the motor 120. The drive shaft 130 may pass through the main frame 140 and may be coupled to the orbiting scroll 160, and the orbiting scroll 160 coupled to the drive shaft 130 may make orbital movements.

The main frame 140 may be disposed between the motor 120 and the orbiting scroll 160 while installed in the inner space of the casing 110. The inner space of the casing 110 may be divided into the motor portion and the compression portion by the main frame 140.

Drive shaft supporters 141, 142 that support the drive shaft 130 configured to pass through the main frame 140 may be formed at a center of the main frame 140 in a radial direction thereof. A main bearing 101 that supports the drive shaft 130 in the radial direction of the main frame 140 may be installed at the drive shaft supporters 141, 142.

The fixed scroll 150 may be installed in the inner space of the casing 110, specifically, in the compression portion. The fixed scroll 150 may be disposed closer to the outlet 113 than to the motor 120 disposed in the motor portion. The orbiting scroll 160 may be disposed between the motor 120 and the fixed scroll 150. The orbiting scroll 160 may be engaged with the fixed scroll 150 to form a compression chamber.

A self-rotation prevention member 170 may be provided between the fixed scroll 150 and the orbiting scroll 160. The self-rotation prevention member 170 may prevent self-rotation of the orbiting scroll 160 such that the orbiting scroll 160 orbits in the fixed scroll 150.

In the scroll compressor 100 with the above-described configuration, refrigerant may be suctioned into the scroll compressor 100 through the inlet 111. The refrigerant, suctioned as described above, may pass through the motor portion and flow into the compression portion. The refrigerant, suctioned into the compression portion, may be suctioned into the compression chamber formed by the orbiting scroll 160 and the fixed scroll 150 that are engaged with each other and then compressed. The high-pressure refrigerant, compressed in the compression chamber, may be discharged out of the scroll compressor 100 through the outlet 113.

Reference numeral 107 that has not been described indicates a cover configured to cover an upper portion of the fixed scroll 150 and to support the fixed scroll 150 from a top.

Figure 4:
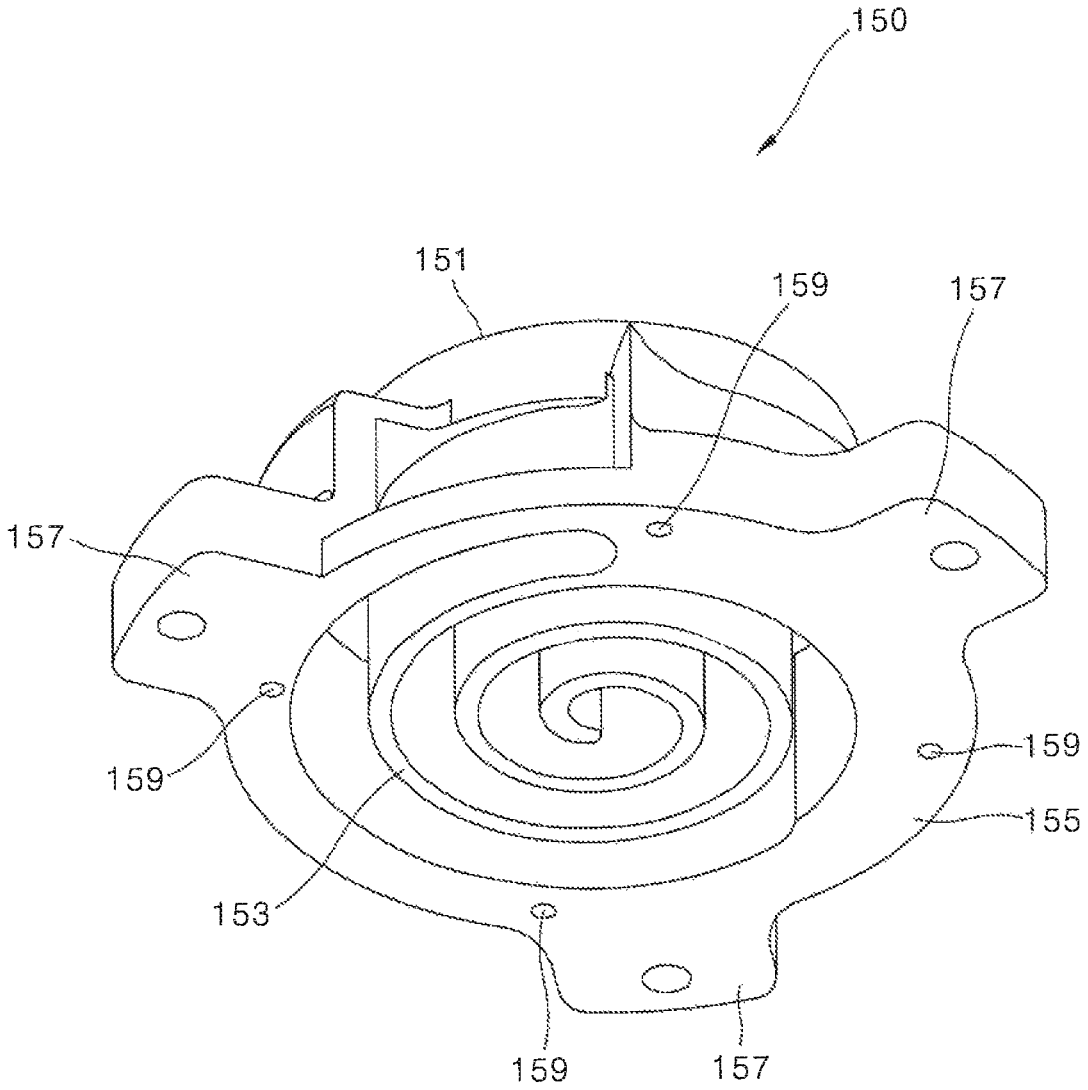
FIG. 4 is a bottom perspective view of a fixed scroll of FIG. 1.

FIG. 4 is a bottom perspective view of a fixed scroll of FIG. 1. Referring to FIGS. 1 to 4, the fixed scroll 150 may include a fixed head plate 151 and a fixed wrap 153.

The fixed head plate 151 may have an approximately circular plate shape, and may form a flat surface. The fixed wrap 153 may protrude from the fixed head plate 151 in a thickness-wise direction of the fixed head plate 151. The fixed wrap 153 may protrude from one surface of the fixed head plate 151, which faces the motor 120, towards the motor 120, and may be engaged with the orbiting scroll 160 to form the compression chamber.

A discharge port may be formed at the fixed scroll 150. The discharge port may form a passage that discharges refrigerant suctioned into the compression chamber out of the compression chamber. The discharge port may penetrate the fixed head plate 151, and may be disposed closer to a central portion of the compression chamber than to a suction port.

The discharge port may be connected with the outlet 113 formed on the casing 110. Accordingly, high-pressure refrigerant that are compressed in the compression chamber and then discharged out of the compression chamber through the discharge port may be discharged out of the scroll compressor 100 through the outlet 113. The discharge port may be opened and closed by a valve 105 installed at the fixed scroll 150.

Further, the fixed scroll 150 may be provided with a lateral wall 155. The lateral wall 155 may protrude in a same direction as a direction in which the fixed wrap 153 protrudes while protruding from the fixed head plate 151 in the thickness-wise direction thereof. The lateral wall 155 may be formed to surround the fixed wrap 153 at an outside of the fixed scroll 150 in a radial direction thereof.

The lateral wall 155 may have a thickness thicker than a thickness of the fixed wrap 153 and may increase a structural strength of the fixed scroll 150. Additionally, the lateral wall 155 may provide a coupling surface that is required for the self-rotation prevention member 170 described hereinafter to be coupled to the fixed scroll 150. In some embodiments, the lateral wall 155 may be thick enough to be coupled to the self-rotation prevention member 170 considering the thickness of the self-rotation prevention member 170.

The fixed scroll 150 may be provided with an installation groove 159. The installation groove 159 may be concave and may be formed at the fixed scroll 150, specifically, on a surface of the lateral wall 155 that faces the orbiting scroll 160. The installation groove 159 may be provided for coupling the self-rotation prevention member 170 and the fixed scroll 150. The self-rotation prevention member 170 may be fitted-coupled to the installation groove 159, and through the fitted-coupling between the installation groove 159 and the self-rotation prevention member 170, the self-rotation prevention member 170 may be installed on the fixed scroll 150.

The installation groove 159 may be exposed in the same direction as the direction in which the fixed wrap 153 is exposed on the fixed scroll 150. That is, the installation groove 159 may be formed at a position at which the fixed wrap 153 and the installation groove 159 are viewable together.

In the structure in which the installation groove 159 is formed at a position on the fixed scroll 150 at which the fixed wrap 153 and the installation groove 159 are viewable together, the fixed wrap 153 and the installation groove 159 may be processed simultaneously. In a case in which the fixed wrap 153 and the installation groove 159 are processed simultaneously, the installation groove 159 may be precisely processed in accordance with a position and shape of the installation groove 159, which are set considering a position and shape of the fixed wrap 153.

Further, the fixed wrap 153 and the installation groove 159 may be processed at one time. Accordingly, a number of operations required for manufacturing and manufacturing costs may be reduced.

The fixed scroll 150 may be further provided with a frame coupler 157. The frame coupler 157 may protrude from the lateral wall 155 outwards in the radial direction of the fixed scroll 150. The frame coupler 157 may be provided as a portion for coupling the fixed scroll 150 and the main frame 140 and may be coupled to a second supporter 145 of the main frame 140 described hereinafter.

The fixed scroll 150 may be provided with a plurality of frame couplers 157. The plurality of frame couplers 157 may be spaced a predetermined distance apart along a circumference of the fixed head plate 151.

Figure 5:
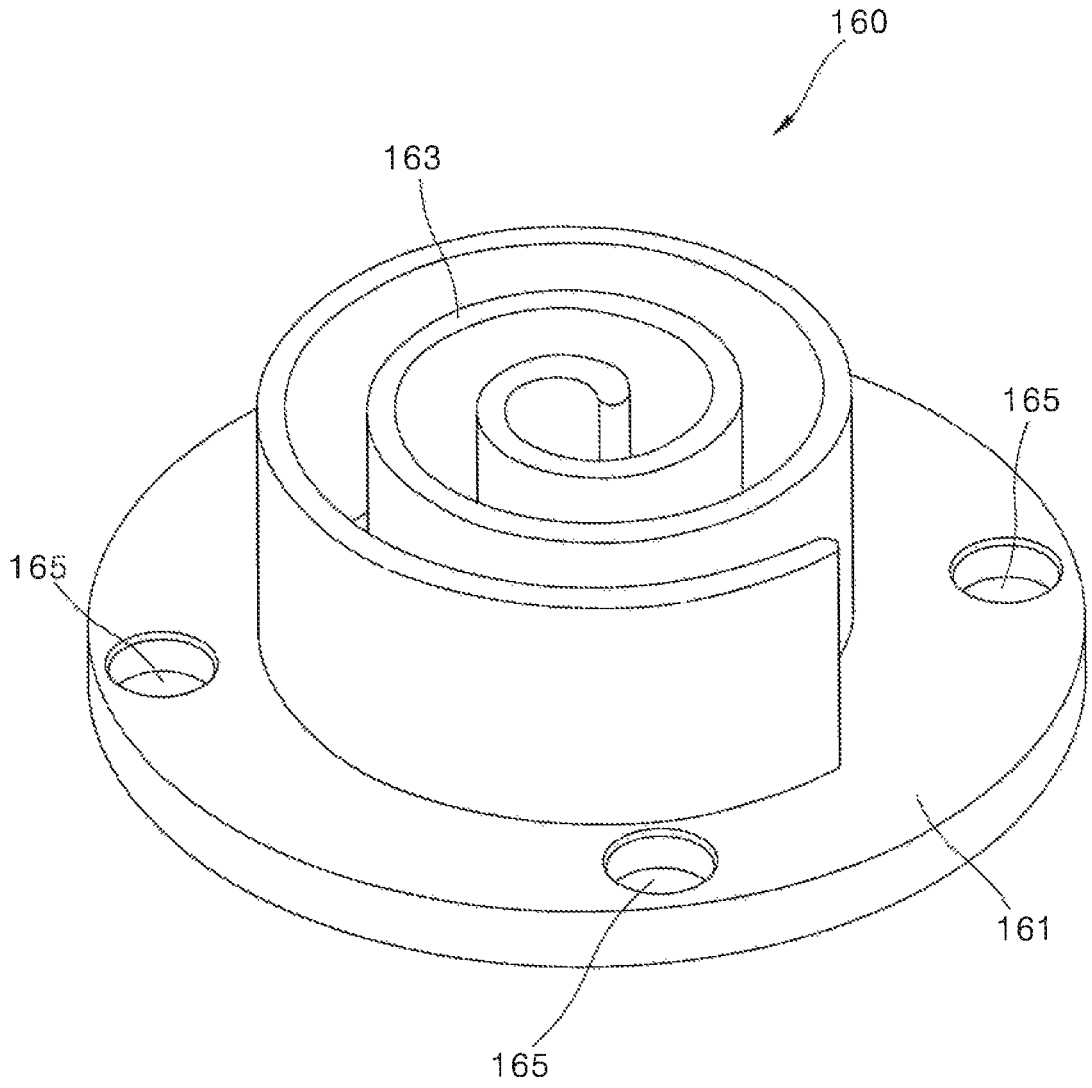
FIG. 5 is a top perspective view of an orbiting scroll of FIG. 1.
Figure 6:
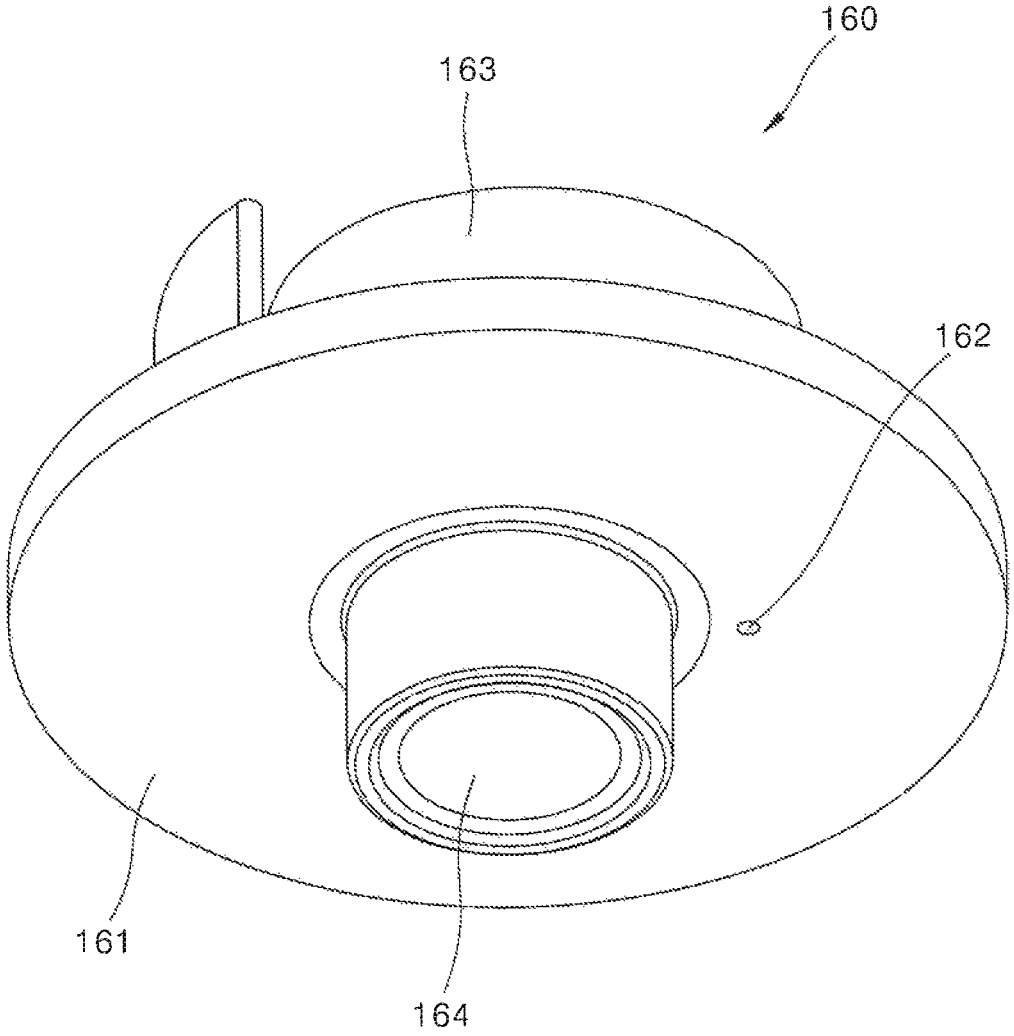
FIG. 6 is a bottom perspective view of the orbiting scroll of FIG. 1.

FIG. 5 is a top perspective view of an orbiting scroll of FIG. 1. FIG. 6 is a bottom perspective view of the orbiting scroll of FIG. 1.

Referring to FIG. 1 and FIGS. 5 and 6, the orbiting scroll 160 may include an orbiting head plate 161 and an orbiting wrap 163. The orbiting head plate 161 may have an approximately circular plate shape. The orbiting head plate 161 may include a flat surface that faces the fixed head plate 151 of the fixed scroll 150 at one or a first side of the orbiting head plate 161, and a flat surface that faces the main frame 140 at another or a second side of the orbiting head plate 161.

The orbiting wrap 163 may protrude from the orbiting head plate 161 in a thickness-wise direction of the orbiting head plate 161. The orbiting wrap 163 may protrude from the one side of the orbiting head plate 161 towards the orbiting head plate 161 of the fixed scroll 150, and may be engaged with the fixed scroll 150 to form the compression chamber.

The orbiting scroll 160 may be provided with a shaft coupler 164. The shaft coupler 164 may be provide at the orbiting head plate 161, specifically, on the other surface of the orbiting head plate 161, which faces the self-rotation prevention member 170. The drive shaft 130 may be coupled to the shaft coupler 164, and through the coupling between the shaft coupler 164 and the drive shaft 130, the orbiting scroll 160 and the drive shaft 130 may be coupled. A sub bearing 103 that supports the drive shaft 130 in a radial direction of the orbiting scroll 160 may be installed at the shaft coupler 164.

The shaft coupler 164 may be disposed at a center of the orbiting head plate 161 in the radial direction thereof. As the shaft coupler 164 is eccentrically coupled to the drive shaft 130, the orbiting scroll 160 may be eccentrically coupled to the drive shaft 130. The orbiting scroll 160 eccentrically coupled to the drive shaft 130 may orbit by rotation of the drive shaft 130.

Self-rotation of the orbiting scroll 160 may be prevented by the self-rotation prevention member 170 coupled to the orbiting scroll 160. For a coupling between the orbiting scroll 160 and the self-rotation prevention member 170, the orbiting scroll 160 may be provided with a guide groove 165. The guide groove 165 may be concave and may be formed on the one surface of the orbiting head plate 161, which faces the fixed head plate 151 of the fixed scroll 150.

The guide groove 165 may be formed on the one surface of the orbiting head plate 161 from which the orbiting wrap 163 protrudes while formed at the orbiting head plate 161. That is, the guide groove 165 may be formed on a same surface as a surface on which the orbiting wrap 163 is formed.

In the above-described structure where the orbiting wrap 163 and the guide groove 165 are formed together on the one surface of the orbiting head plate 161, the orbiting wrap 163 and the guide groove 165 may be processed simultaneously. In a case in which the orbiting wrap 163 and the guide groove 165 are processed simultaneously, the guide groove 165 may be precisely processed in accordance with a position and shape of the guide groove 165 which is designed considering a position and shape of the orbiting wrap 163.

Further, the orbiting wrap 163 and the guide groove 165 may be processed together at one time. Accordingly, a number of operations required for manufacturing and manufacturing costs may be reduced.

The orbiting scroll 160 may be provided with a back-pressure hole 162. The back-pressure hole 162 may be a passage formed on the orbiting scroll 160 such that some of the refrigerant suctioned into the compression chamber may be discharged out of the compression chamber.

The back-pressure hole 162 may be a through hole that passes through the orbiting head plate 161 in the thickness-wise direction thereof. The back-pressure hole 162 may form a passage on the orbiting scroll 160 such that some of the refrigerant suctioned into the compression chamber may be discharged out of the compression chamber through another passage rather than the discharge port. In some embodiments, the back-pressure hole 162 may be disposed further inwards in the radial direction of the orbiting head plate 161 rather than a back-pressure chamber 147 described hereinafter.

The refrigerant, discharged out of the compression chamber through the back-pressure hole 162, may serve as a pressure generator that generates a pressure that brings the orbiting scroll 160 into close contact with the fixed scroll 150 while widening a gap between the orbiting scroll 160 and the main frame 140. That is, as the back-pressure hole 162 is formed at the orbiting scroll 160, an intermediate pressure is applied between the orbiting scroll 160 and the main frame 140, the orbiting scroll 160 is effectively pressed against the fixed scroll 150, and friction loss caused by friction between the orbiting scroll 160 and the main frame 140 may be reduced when the orbiting scroll 160 orbits.

Figure 7:
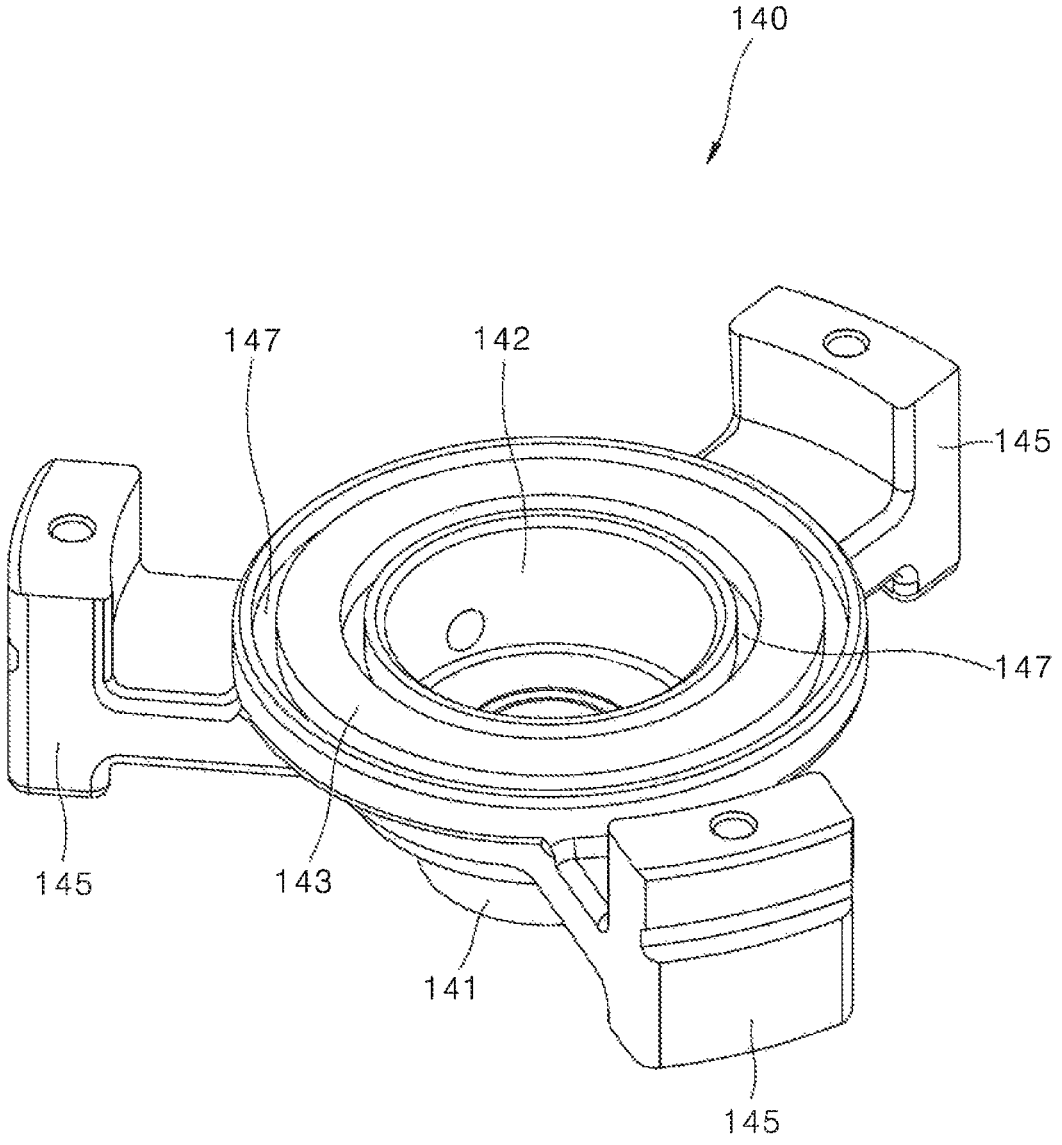
FIG. 7 is a perspective view of a main frame of FIG. 1.

FIG. 7 is a perspective view of a main frame of FIG. 1. Referring to FIGS. 1 and 7, the main frame 140 may include drive shaft supporters 141, 142, a first supporter 143, and second supporter 145.

The drive shaft supporter 141, 142 may be divided into first drive shaft supporter 141 and second drive shaft supporter 142. The first drive shaft supporter 141 may directly support the drive shaft 130, and may be provided with main bearing 101. The second drive shaft supporter 142 may be disposed between the first drive shaft supporter 141 and the orbiting head plate 161, and the drive shaft 130 and the shaft coupler 164 coupled to the drive shaft 130 may be inserted into the second drive shaft supporter 142. The first drive shaft supporter 141 may have an inner space that may accommodate the drive shaft 130 and the main bearing 101 coupled to the drive shaft 130.

The second drive shaft supporter 142 may accommodate the drive shaft 130 and a portion of the orbiting scroll 160 coupled to the drive shaft 130. In some embodiments, a portion of the orbiting scroll 160 accommodated in the second drive shaft supporter 142 is an example of the shaft coupler 164 described hereinafter. The shaft coupler 164 may be coupled to the drive shaft 130 to couple the orbiting scroll 160 to the drive shaft 130 and may be accommodated in the second drive shaft supporter 142.

The second drive shaft supporter 142 may have an inner space in a range or wider of orbital movement of the shaft coupler 164 that orbits according to an orbital movement of the orbiting scroll 160. That is, the second drive shaft supporter 142 may have an inner diameter larger than an inner diameter of the first drive shaft supporter 141. Accordingly, a step may be formed between the first drive shaft supporter 141 and the second drive shaft supporter 142.

The first supporter 143 may be disposed at one or a first side of the main frame 140 facing the orbiting scroll 160. The first supporter 143 may have a circular plate shape, and the second drive shaft supporter 142 may be disposed at a center of the first supporter 143 in a radial direction thereof. The first supporter 143 may be disposed to face another or a second surface of the orbiting head plate 161 and support the orbiting scroll 160.

The second supporter 145 may be disposed outside of the first supporter 143 in the radial direction thereof. The second supporter 145 may protrude from the first supporter 143 outwards in the radial direction of the first supporter 143. An outer end of the second supporter 145 in the radial direction thereof may protrude towards the fixed scroll 150. The second supporter 145 formed as described above may be coupled to the frame coupler 157 provided at the fixed scroll 150.

The main frame 140 may be provided with a plurality of second supporters 145. The plurality of second supporters 145 may be spaced a predetermined distance apart along a circumference of the first supporter 143.

As an example, the main frame 140 may be provided with the second supporter 145, and the number of the second supporters 145 may correspond to the number of the frame couplers 157. The plurality of second supporters 145 may be disposed at positions corresponding to positions of the plurality of frame couplers 157.

Through the above-described coupling between the frame coupler 157 and the second supporter 145, the main frame 140 and the fixed scroll 150 may be coupled. As the frame coupler 157 and the second supporter 145 may be coupled at a plurality of points, the main frame 140 and the fixed scroll 150 may be coupled more stably.

The plurality of second supporters 145 may be disposed outside an area in which the orbiting scroll 160 orbits while disposed further outwards than the orbiting scroll 160 supported by the first supporter 143. When the plurality of second supporters 145 is disposed as described above, the second supporter 145 and the orbiting scroll 160 may not interfere with each other.

The main frame 140 may be provided with back-pressure chamber 147. The back-pressure chamber 147 may be provided at the one side of the main frame 140, which faces the orbiting scroll 160, specifically, on one or a first surface of the first supporter 143, which faces the orbiting head plate 161.

Refrigerant discharged out of the compression chamber through the back-pressure hole 162 may be suctioned into the back-pressure chamber 147. The refrigerant suctioned into the back-pressure chamber 147 may serve as a pressure generator that generates a pressure that brings the orbiting scroll 160 into close contact with the fixed scroll 150 while widening a gap between the orbiting scroll 160 and the main frame 140. The back-pressure chamber 147 may provide an installation space for installing a sealing member 190 described hereinafter at the main frame 140.

Figure 8:
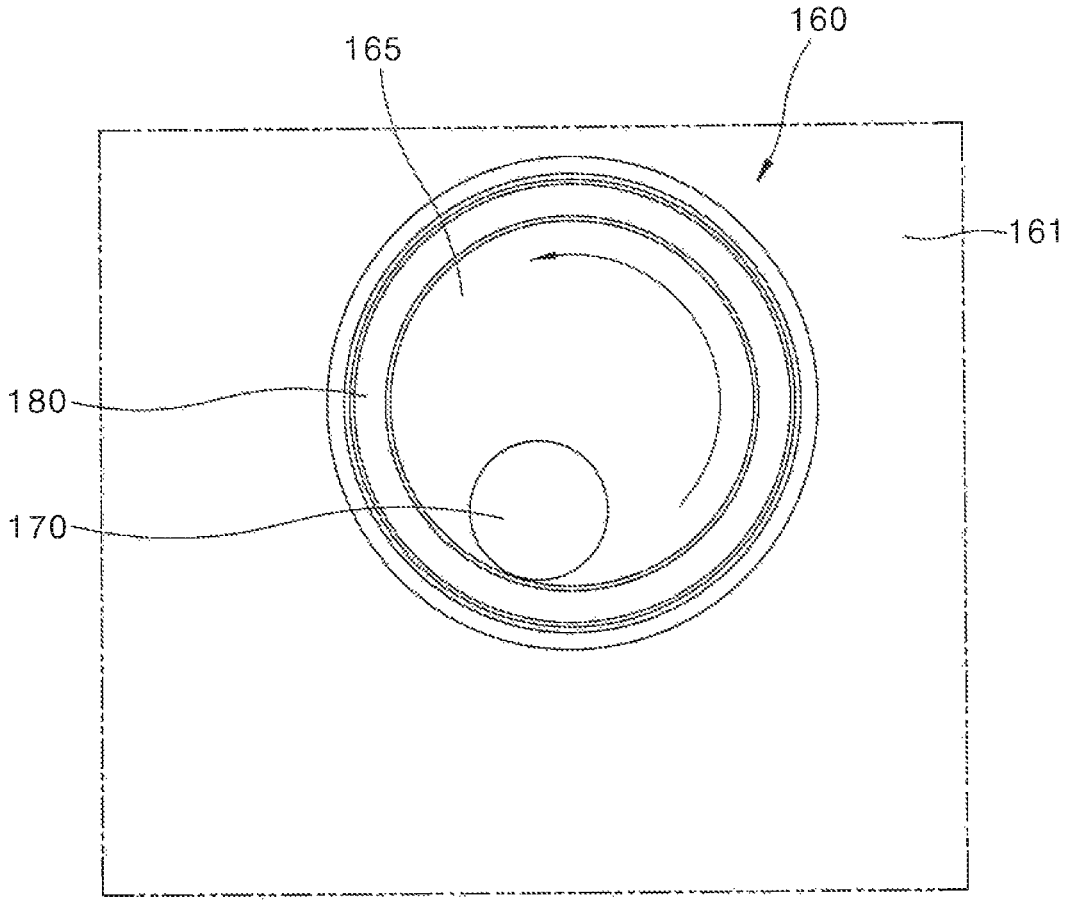
FIG. 8 is a view illustrating a coupling structure between a self-rotation prevention member and a guide groove of FIG. 1.
Figure 9:
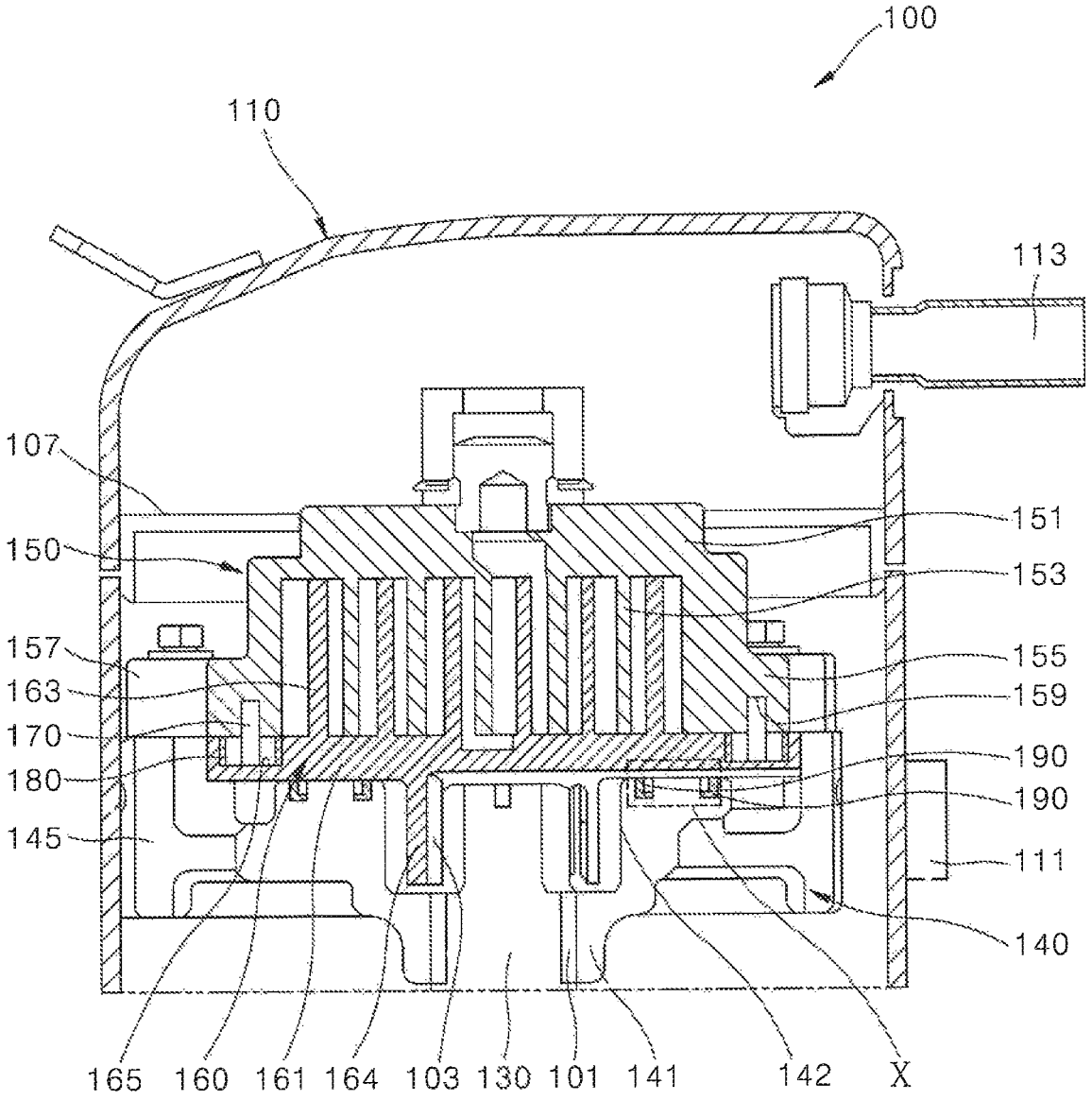
FIG. 9 is a cross-sectional view of a compression portion of the scroll compressor of FIG. 1.

FIG. 8 is a view of a coupling structure between the self-rotation prevention member and the guide groove of FIG. 1. FIG. 9 is a cross-sectional view of a compression portion of the scroll compressor of FIG. 1.

Referring to FIGS. 8 and 9, guide groove 165 may be formed at any one of the fixed scroll 150 or the orbiting scroll 160, and self-rotation prevention member 170 may be installed at the other. In one embodiment, for example, the guide groove 165 may be formed at the orbiting scroll 160 and the self-rotation prevention member 170 formed at the fixed scroll 150.

According to one embodiment, the guide groove 165 may be concave and may be formed on the one surface of the orbiting head plate 161, which faces the fixed head plate 151. The guide groove 165 may have a circular groove shape, and may be formed on the one surface of the orbiting head plate 161, and may be concave in a direction away from the fixed head plate 151.

According to one embodiment, the orbiting wrap 163 may protrude from the one surface of the orbiting head plate 161 towards the fixed head plate 151 at the orbiting head plate 161. In some embodiments, the orbiting wrap 163 may be disposed at a center of the orbiting head plate 161 in the radial direction thereof on the orbiting head plate 161. Additionally, the guide groove 165 may be disposed further outwards than the orbiting wrap 163 in the radial direction of the orbiting wrap 163.

The fixed wrap 153 may protrude from the one surface of the fixed head plate 151 towards the orbiting head plate 161. In some embodiments, the fixed wrap 153 may be disposed at a center of the fixed head plate 151 in the radial direction thereof.

The self-rotation prevention member 170 may be disposed between the fixed head plate 151 and the orbiting head plate 161. The self-rotation prevention member 170 may be installed at the fixed scroll 150. The fixed scroll 150 may be provided with installation groove 159. The installation groove 159 may be concave and may be formed on the one surface of the lateral wall 155 facing the orbiting head plate 161.

The installation groove 159 may be disposed further outwards than the fixed wrap 153 in the radial direction of the fixed scroll 150. Accordingly, the self-rotation prevention member 170 coupled to the installation groove 159 may also be disposed further outwards than the fixed wrap 153 in the radial direction of the fixed scroll 150.

In the above-described arrangement of the self-rotation prevention member 170 and the installation groove 159, a self-rotation prevention structure formed by the coupling between the self-rotation prevention member 170 and the installation groove 159 may be disposed further outwards than the compression chamber formed by engagement between the fixed wrap 153 and the orbiting wrap 163 in the radial direction of fixed scroll 150. That is, when the fixed scroll 150 and the orbiting scroll 160 are engaged with each other, the compression chamber for compressing refrigerant may be formed inwards in the radial direction of the fixed scroll 150 and the orbiting scroll 160, and a structure for preventing self-rotation of the orbiting scroll 160 may be disposed outwards in the radial direction of the fixed scroll 150 and the orbiting scroll 160.

The self-rotation prevention member 170 may have a cylindrical pin shape having a length that extends in a vertical direction. At least a portion of the self-rotation prevention member 170 may be fitted-coupled to the installation groove 159 in a state of being inserted into the installation groove 159 and may be installed at the fixed head plate 151. The self-rotation prevention member 170 installed as described above may protrude towards the guide groove 165, and at least a portion of the self-rotation prevention member 170 formed as described above may be inserted into an inner space of the guide groove 165.

The self-rotation prevention member 170, as described above, may have a cylindrical pin shape having a predetermined diameter, and the guide groove 165 may have a circular shape having a diameter larger than the diameter of the self-rotation prevention member 170. The self-rotation prevention member 170, inserted into the guide groove 165, may restrict movement of the orbiting scroll 160 in a predetermined range while revolving in the inner space of the guide groove 165 to prevent self-rotation of the orbiting scroll 160.

The self-rotation prevention member 170 may have a length longer than a depth of the installation groove 159 and shorter than a distance between mutually facing bottoms of the guide groove 165 and the installation groove 159. That is, the self-rotation prevention member 170 may be long enough to be inserted into an inner area of the guide groove 165 even in a state of being fitted-coupled to the installation groove 159 and may be short enough not to contact a bottom of the guide groove 165 even in the state of being inserted deepest into the installation groove 159.

As the self-rotation prevention member 170 is formed as described above, at least a portion of the self-rotation prevention member 170 may remain inserted stably in the inner area of the guide groove 165. Additionally, even when the length of the self-rotation prevention member is increased due to thermal expansion of the self-rotation prevention member 170, friction between the self-rotation prevention member 170 and the bottom of the guide groove 165 may be prevented.

The scroll compressor 100 according to embodiments may further include a ring 180. The ring 180 may be inserted into the guide groove 165 and may have a ring shape having an outer radial corresponding to an inner radial of the guide groove 165.

When the ring 180, as described above, is installed at the guide groove 165, an area, in which the self-rotation prevention member 170 can revolve, may be limited to an inner area of the ring 180. When the orbiting scroll 160 orbits, the self-rotation prevention member 170 revolves in the revolvable area set by the ring 180. Accordingly, self-rotation of the orbiting scroll 160 may be prevented. In some embodiments, the self-rotation prevention member 170 may revolve in the inner area of the ring 180 while contacting an inner circumferential surface of the ring 180.

According to one embodiment, a plurality of self-rotation prevention members 170 may be disposed between the fixed scroll 150 and the orbiting scroll 160 and may be spaced a predetermined distance apart along a circumference of the orbiting scroll 160. Additionally, the same number of the guide grooves 165 and rings 180 installed in the guide grooves 165 as the number of the self-rotation prevention members 170 may be provided such that the guide grooves 165 and the rings 180 are disposed at positions corresponding to positions of the self-rotation prevention members 170.

Through the plurality of self-rotation prevention members 10, guide grooves 165, and rings 180 formed as described above, self-rotation may be prevented at a plurality of points. Accordingly, the orbiting scroll 160 may orbit more stably.

The number of the self-rotation prevention members 170 may vary depending on a type and capacity of a compressor. In one embodiment, four self-rotation prevention members 170 are provided between the fixed scroll 150 and the orbiting scroll 160; however, embodiments are not limited thereto.

Figure 10:
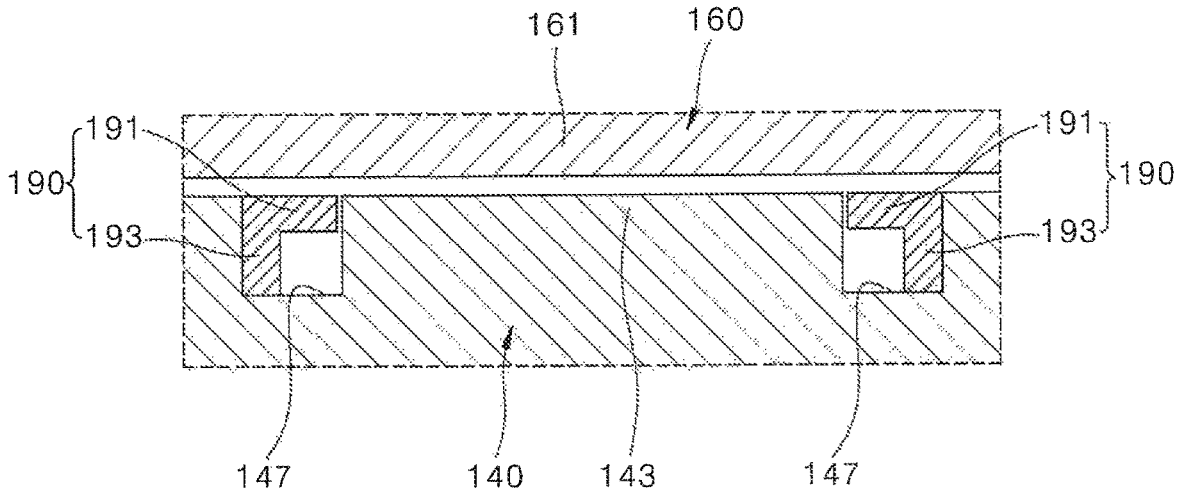
FIG. 10 is an enlarged view illustrating portion "X" in FIG. 9.
Figure 11:
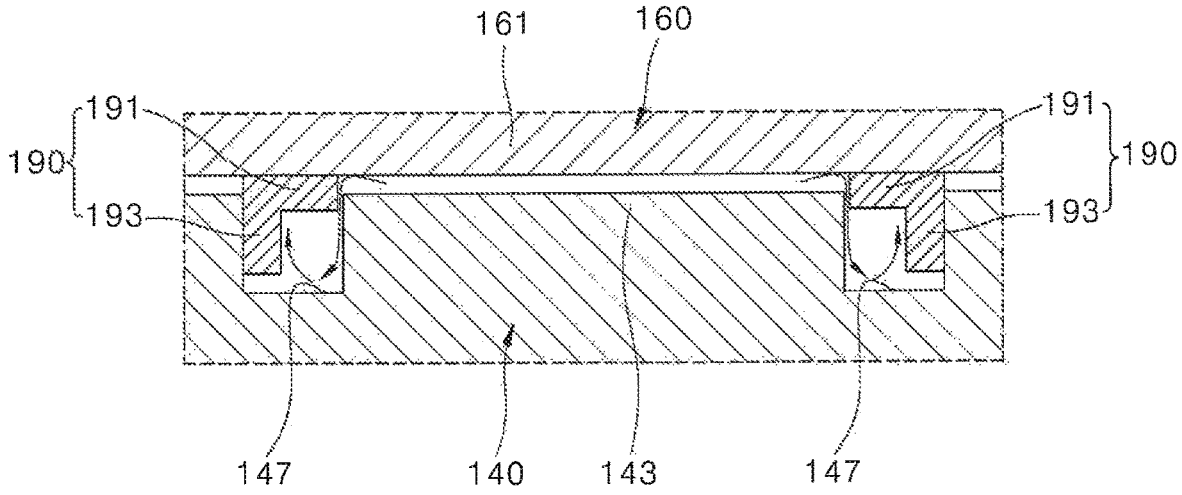
FIG. 11 is a cross-section view of a sealing operation of a sealing member of FIG. 10.

FIG. 10 is an enlarged view illustrating portion "X" in FIG. 9. FIG. 11 is a cross-section view of a sealing operation of a sealing member of FIG. 10.

Referring to FIGS. 9 and 10, the main frame 140 may be provided with back-pressure chamber 147. The back-pressure chamber 147 may be provided at the one side of the main frame 140, which faces the orbiting scroll 160, specifically, on the one surface of the first supporter 143, which faces the orbiting head plate 161.

The back-pressure chamber 147 may be formed on the one surface of the first supporter 143, which faces the orbiting head plate 161, and may be concave in a direction away from the orbiting head plate 161. The back-pressure chamber 147 may have a ring shape that surrounds a center of the first supporter 143 in the radial direction thereof. In one embodiment, for example, the back-pressure chamber 147 may have a ring shape that surrounds the second drive shaft supporter 142, and a pair of back-pressure chambers 147 may be disposed in a concentric circle shape.

According to one embodiment, the back-pressure hole 162 may be formed at the orbiting scroll 160, and some of the refrigerant suctioned into the compression chamber may be discharged out of the compression chamber through the back-pressure hole 162 during a compression process. The refrigerant discharged out of the compression chamber through the back-pressure hole 162 may be suctioned into the back-pressure chamber 147, and the refrigerant suctioned into the back-pressure chamber 147 may serve as a pressure generator that generates a pressure that brings the orbiting scroll 160 into close contact with the fixed scroll 150 while widening a gap between the orbiting scroll 160 and the main frame 140. Accordingly, an intermediate pressure may be applied between the orbiting scroll 160 and the main frame 140, the orbiting scroll 160 may effectively come into close contact with the fixed scroll 150, and friction loss, which may be caused by friction between the orbiting scroll 160 and the main frame 140 when the orbiting scroll 160 orbits, may be reduced.

As illustrated in FIG. 2 and FIGS. 9 and 10, the scroll compressor 100 according to embodiments may further include sealing member 190 disposed between the orbiting scroll 160 and the main frame 140. The sealing member 190 may be installed in the back-pressure chamber 147 and may include a contactor 191 and a supporter 193.

The contactor 191 may be disposed between the orbiting head plate 161 and the back-pressure chamber 147 to come into close contact with the orbiting head plate 161. The supporter 193 may be provided such that at least a portion of the supporter 198 is inserted into the back-pressure chamber 147 and connected with the contactor 191.

The supporter 193 may be formed as a surface that extends in a direction that extends between the orbiting head plate 161 and the back-pressure chamber 147. The contactor 191 may be a surface that extends in parallel with the orbiting head plate 161 and may connect to the supporter 193.

In one embodiment, the contactor 191, for example, may have a ring shape corresponding to a shape of the back-pressure chamber 147. The contactor 191 may have a ring shape with a flat surface that extends in parallel with the orbiting head plate 161. The supporter 193 may have a ring shape with a flat surface in parallel with an inner wall of the back-pressure chamber 147 and may connect with the contactor 191 in a "¬" shape.

A pair of sealing members 190 may be provided in correspondence to a pair of back-pressure chambers 147 disposed in a concentric circle shape. A sealing member 190 installed in an inner one of two back-pressure chambers 147 may be formed as a ring having a size and shape corresponding to the inner one, and a sealing member 190 installed in an outer one of the two back-pressure chambers 147 may be formed as a ring having a size and shape corresponding to the outer one For the sealing member 190 formed as described above, the contactor 191 may not contact the orbiting head plate 161 until a back pressure is formed at the back-pressure chamber 147. When refrigerant suctioned into the compression chamber is compressed, the refrigerant discharged out of the compression chamber through the back-pressure hole 162 may be suctioned into the back-pressure chamber 147 through a gap formed between the sealing member 190 installed in the back-pressure chamber 147 and the back-pressure chamber 147.

As described above, the refrigerant suctioned into the back-pressure chamber 147 may serve as a pressure generator for bringing the orbiting scroll 160 into close contact with the fixed scroll 150 and at the same time for bringing the sealing member 190 into close contact with the orbiting scroll 160 while widening a gap between the orbiting scroll 160 and the main frame 140. Accordingly, as the orbiting scroll 160 comes into close contact with the fixed scroll 150, the sealing member 190, specifically, the contactor 191, may come into close contact with the orbiting scroll 160.

Thus, a sealed space surrounded by the orbiting head plate 161, the first supporter 143 of the main frame 140 and the sealing member 190 may be formed between the orbiting scroll 160 and the main frame 140. That is, sealing between the back-pressure chamber 147 and its surroundings may be done by the sealing member 190 installed in the back-pressure chamber 147.

In the sealing structure, the sealing member 190 may be fixed neither to the orbiting scroll 160 or the main frame 140, and the sealing member 190 and the orbiting scroll 160 may be coupled only through application of a pressure formed in the back-pressure chamber 147. Accordingly, despite orbital movement of the orbiting scroll 160, almost no friction between the sealing member 190 and the orbiting scroll 160 or almost no friction between the sealing member 190 and the main frame 140 is generated. That is, the sealing member 190 is installed such that almost no friction between the sealing member 190 and the orbiting scroll 160 or almost no friction between the sealing member 190 and the main frame 140 is generated while the orbiting scroll 160 orbits. Accordingly, wear on the sealing member 190 may be significantly reduced.

Figure 12:
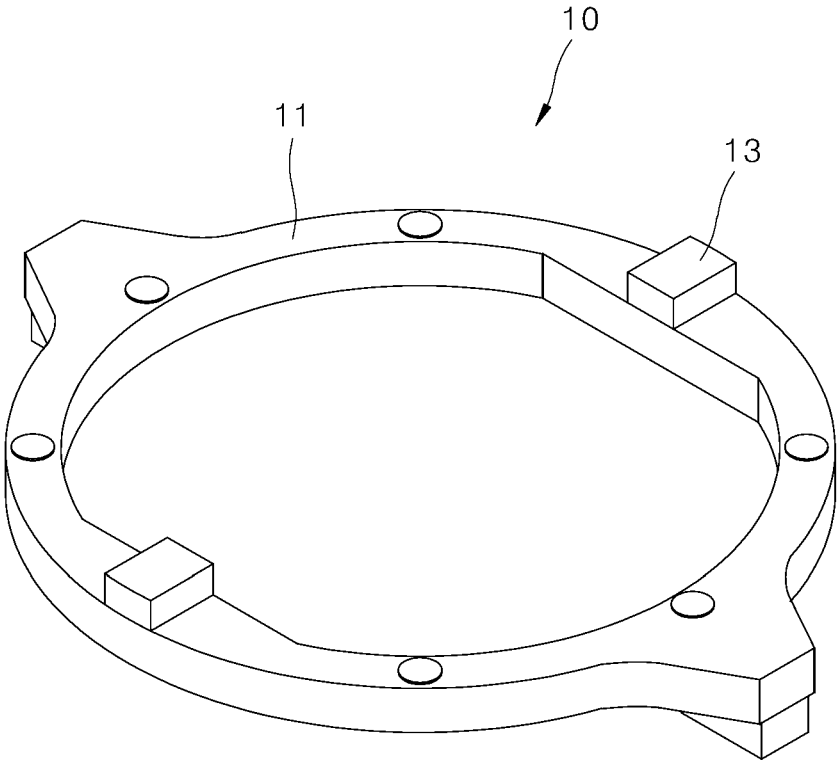
FIG. 12 RELATED ART
FIG. 12 is a perspective view of an Oldham's ring of a compressor of the related art.
Figure 13:
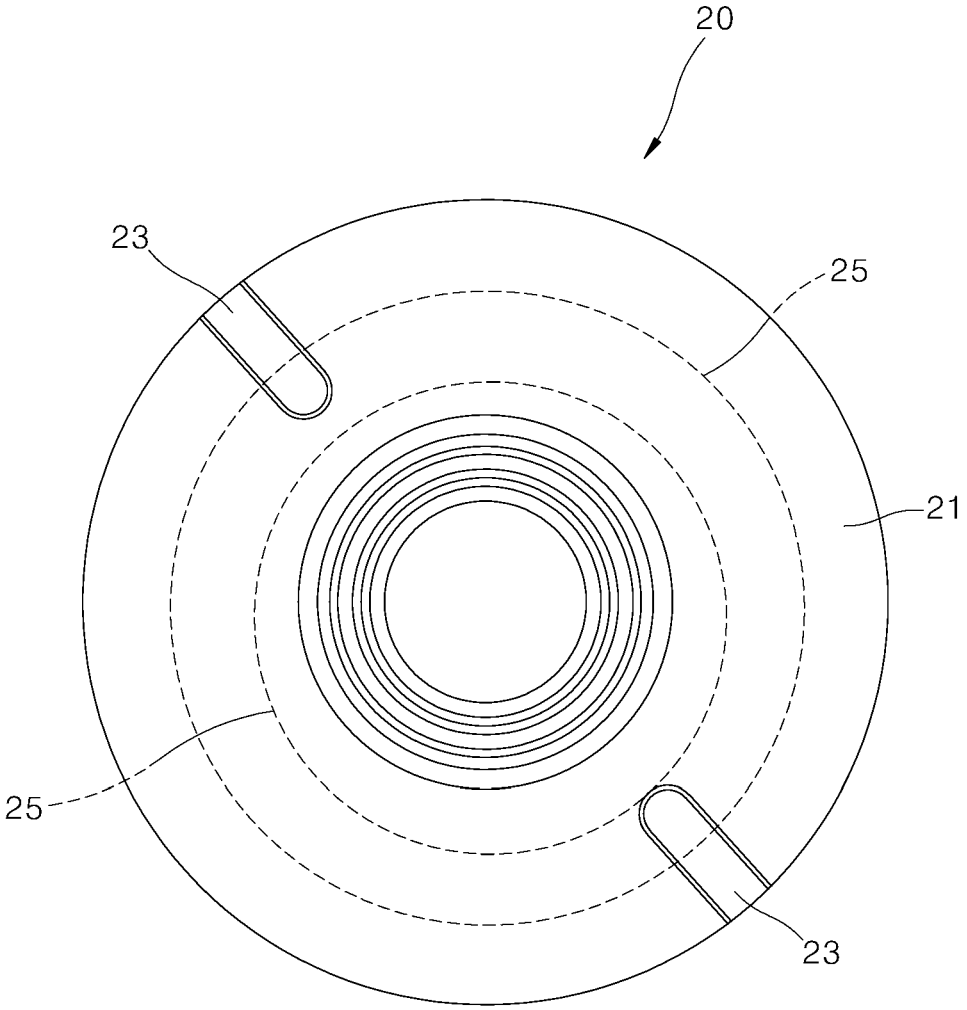
FIG. 13 RELATED ART
FIG. 13 is a bottom view illustrating a bottom of an orbiting scroll of a compressor of the related art.

FIG. 12 is a perspective view of an Oldham's ring of a compressor of the related art. FIG. 13 is a bottom view illustrating a bottom of an orbiting scroll of a compressor of the related art.

Referring to FIGS. 12 and 13, the scroll compressor of the related art is provided with an Oldham's ring 10 as a self-rotation prevention member. The Oldham's ring 10 may be disposed between a main frame and orbiting scroll 20, and may include a ring-shaped body 11 and a key 13 protruding from the body 11 towards the orbiting scroll 20.

Additionally, the orbiting scroll 20 may include a circular plate-shaped head plate 21, and an orbiting wrap formed to protrude in a thickness-wise direction of the head plate 21. A key groove 23 may be provided at a bottom of the head plate 21, which faces the Oldham's ring 10 and the main frame. That is, the key groove 23 may be provided on a surface opposite to the surface on which the orbiting wrap is disposed, on the head plate.

The key groove 23 may be concave and may be formed at a bottom of the head plate 21, and the orbiting scroll 20 and the Oldham's ring 10 may be coupled in a way in which the key 13 is fitted into the key groove 23. The key groove 23 may have a length that extends in a radial direction of the head plate 21 such that the key 13 of the Oldham's ring 10 moves in the key groove 23.

A back-pressure hole may be formed at the orbiting scroll 20, and the back-pressure hole may be formed to penetrate the head plate 21 of the orbiting scroll 20. Some of the refrigerant suctioned into a compression chamber may be discharged out of the compression chamber through the back-pressure hole. The refrigerant discharged out of the compression chamber through the back-pressure hole may be suctioned into the back-pressure chamber 25 and may generate a pressure for bringing the orbiting scroll 20 into close contact with a fixed scroll.

In the scroll compressor according to embodiments, the back-pressure chamber 147 (see. FIG. 9) is formed at the main frame 140 (see. FIG. 9) while in the scroll compressor of the related art, the back-pressure chamber 25 is formed at the orbiting scroll 20. The back-pressure chamber 25 of the scroll compressor of the related art is formed at the bottom of the head plate 21, which faces the main frame. To generate a back pressure for bringing the orbiting scroll 20 into close contact with the fixed scroll, the back-pressure chamber 25 has to be formed between the main frame and the orbiting scroll 20.

In this case, the key groove 23 and the back-pressure chamber 25 are formed on the same surface of the head plate 21. To smoothly generate back pressure, the key groove 23 and the back-pressure chamber 25 should not be overlapped. Considering this fact, the key groove 23 has to be disposed further outwards than the back-pressure chamber 25.

When the key groove 23 and the back-pressure chamber 25 are disposed as described above, an entire size of the orbiting scroll 20 has to be large. That is, the orbiting scroll 20 is scaled up without improving performance of a scroll compressor, thereby scaling up the scroll compressor.

In the scroll compressor 100 according to embodiments, as illustrated in FIG. 9, a component in relation to formation of a back pressure and a component in relation to prevention of self-rotation of the orbiting scroll 160 are not disposed on the same surface of the orbiting scroll 160. That is, back-pressure chamber 147, one of the components in relation to formation of back pressure, is formed on the main frame 140 rather than the orbiting scroll 160. Additionally, the guide groove 165, a component in relation to prevention of self-rotation, is formed on a surface opposite to a surface that faces the main frame 140 while formed at the orbiting scroll 160.

The guide groove 165 may be formed on a surface opposite to a surface that faces the main frame 140 when the self-rotation prevention member 170 is disposed between the orbiting scroll 160 and the fixed scroll 150 rather than between the orbiting scroll 160 and the main frame 140. Additionally, the self-rotation prevention member 170 may be disposed between the orbiting scroll 160 and the fixed scroll 150 rather than between the orbiting scroll 160 and the main frame 140 when the self-rotation prevention member 170 is provided in a pin and ring shape rather than an Oldham's ring shape.

In the above-described arrangement of the back-pressure chamber 147 and the guide groove 165, the back-pressure chamber 147 and the guide groove 165 may be respectively disposed at positions where they do not affect each other. Accordingly, even when the back-pressure chamber 147 and the guide groove 165 are disposed at a position where the back-pressure chamber 147 and the guide groove 165 overlap in a direction where the drive shaft 130 extends, that is, in the vertical direction, the guide groove 165 may not adversely affect formation of back pressure or the back-pressure chamber 147 may not adversely affect operations of the self-rotation prevention member 170 for preventing self-rotation.

Accordingly, the orbiting scroll 160 does not need to be scaled up to form the back-pressure chamber 147 and the guide groove 165. Thus, the scroll compressor 100 may have a compact size and provide excellent performance.

The back-pressure chamber 147 may be disposed between the orbiting scroll 160 and the main frame 140. Accordingly, an intermediate pressure may be applied between the orbiting scroll 160 and the main frame 140. Generally, a scroll compressor 100 with the above-described structure may be classified as a lower back pressure-type scroll compressor. A scroll compressor with the back-pressure chamber disposed at an upper portion of the fixed scroll and the orbiting scroll may be classified as an upper back pressure-type scroll compressor.

The upper back pressure-type scroll compressor may have a fixed back-pressure chamber. Accordingly, the fixed scroll is unlikely to tilt and the back-pressure chamber is well sealed. The upper back pressure-type scroll compressor may have a more complex structure for forming a back-pressure chamber than the lower back pressure-type scroll compressor.

The lower back pressure-type scroll compressor may have a simple structure for forming a back-pressure chamber. In the lower back pressure-type scroll compressor, a back-pressure chamber may be disposed at a bottom of an orbiting scroll that makes orbital movement. Accordingly, a shape and position of the back-pressure chamber may be changed according to the orbital movement. Thus, the orbiting scroll may make noise and create vibration while the orbiting scroll tilts, and an O-ring inserted to prevent leakage from the back-pressure chamber may rapidly wear.

Considering this fact, in the scroll compressor 100 according to embodiments, the back-pressure chamber 147 may be formed on the main frame 140 rather than the orbiting scroll 160, and the sealing member 190 may be fixed to neither of the orbiting scroll 160 or the main frame 140. Effects of the scroll compressor 100 with the above-described configuration are described as follows.

First, the back-pressure chamber 147 is formed on the main frame 140 rather than the orbiting scroll 160, thereby making it possible to reduce the possibility of tilt, and vibration and noise caused by the tilt of the orbiting scroll 160 unlike the back-pressure chamber formed at the orbiting scroll 160. When the back-pressure chamber is formed on the main frame 140 rather than the orbiting scroll 160, a shape and position of the back-pressure chamber is not changed according to an orbital movement of the orbiting scroll 160.

Second, the sealing member 190 is fixed to neither the orbiting scroll 160 or the main frame 140, and performs a sealing function using a back pressure formed in the back-pressure chamber 147, thereby making it possible to significantly reduce wear on the sealing member 190. Third, the scroll compressor 100 according to embodiments, may be provided as the lower back pressure-type scroll compressor in which the back pressure chamber 147 is formed between the orbiting scroll 160 and the main frame 140, thereby making it possible to omit a complicated structure for forming the back-pressure chamber from the scroll compressor 100. That is, the scroll compressor 100 according to embodiments may be provided without a number of complex structures that are provided to form a back-pressure chamber in the upper back pressure-type scroll compressor of the related art, thereby lowering a level of manufacturing difficulty and cutting off manufacturing costs.

Embodiments disclosed herein provide a scroll compressor that may have a compact size and provide improved functions. Embodiments disclosed herein provide a scroll compressor having an improved structure capable of enhancing accuracy of an alignment for compression. Additionally, embodiments disclosed herein provide a scroll compressor that may have an improved structure capable of helping lower a level of manufacturing difficulty and cut off manufacturing costs.

In a scroll compressor according to embodiments, a guide groove may be formed at one of a fixed scroll or an orbiting scroll, and a self-rotation prevention member may be formed at the other, configured to be inserted into the guide groove to revolve in the guide groove and configured to prevent self-rotation of the orbiting scroll. The guide groove may be formed on one surface of an orbiting head plate from which an orbiting wrap protrudes.

In a scroll compressor according to another embodiment, a back-pressure chamber formed to generate an intermediate pressure may be disposed at a main frame. With this configuration, a component in relation to formation of a back pressure and a component in relation to prevention of a self-rotation of an orbiting scroll may be disposed respectively at positions where the components do not interfere with each other, thereby making it possible to provide a scroll compressor having a compact size and excellent performance.

According to one embodiment, a scroll compressor may include a casing having a sealed inner space; a fixed scroll disposed in the inner space of the casing; an orbiting scroll coupled to the fixed scroll to form a compression chamber and configured to make an orbital movement; and a main frame configured to support the orbiting scroll and having a back-pressure chamber configured to communicate with the compression chamber at one side of the main frame, which faces the orbiting scroll. The orbiting scroll may include an orbiting wrap engaged with the fixed scroll to form the compression chamber; an orbiting head plate disposed between the orbiting wrap and the main frame; and a back-pressure hole penetrating the orbiting head plate and providing communication between the compression chamber and the back-pressure chamber. One of the fixed scroll or the orbiting scroll may be provided with a guide groove, and the other of the fixed scroll or the orbiting scroll may be provided with a self-rotation prevention member configured to be inserted into the guide groove such that the self-rotation prevention member revolves in the guide groove. The guide groove may be formed on one surface of the orbiting head plate from which the orbiting wrap protrudes.

The guide groove may be concave and may be formed on one surface of the orbiting head plate, which faces the fixed scroll. The self-rotation prevention member may be installed at the fixed scroll and may be configured to protrude towards the guide groove.

The fixed scroll may be provided with a concave installation groove. The self-rotation prevention member may be fitted-coupled to the installation groove such that at least a part or portion of the self-rotation prevention member protrudes towards the guide groove.

The fixed scroll may include a fixed head plate configured to face the orbiting head plate, and a fixed wrap disposed between the orbiting head plate and the fixed head plate and engaged with the orbiting wrap to form the compression chamber. The fixed wrap and the installation groove may be formed on a surface that faces the orbiting head plate while formed at the fixed head plate.

The self-rotation prevention member may have a length longer than a depth of the installation groove and shorter than a distance between mutually facing bottoms of the guide groove and the installation groove. The self-rotation prevention member may have a pin shape having a predetermined diameter, and the guide groove may have a circular groove shape having a diameter larger than that of the self-rotation prevention member.

The scroll compressor may further include a ring configured to be inserted into the guide groove. The self-rotation prevention member may revolve in the ring while contacting an inner circumferential surface of the ring.

The main frame may include a first supporter disposed to face another surface of the orbiting head plate and configured to support the orbiting scroll, and a second supporter disposed outwards in a radial direction of the first supporter and coupled to the fixed scroll. The back-pressure chamber may be concave and may be formed at the first supporter. The back-pressure chamber may be formed on one surface of the first supporter, which faces the orbiting head plate, and may be concave in a direction away from the orbiting head plate, and may have a ring shape that surrounds a center of the first supporter in the radial direction thereof.

A pair of back-pressure chambers may be disposed in a concentric circle shape. The guide groove may have a circular groove shape having a diameter corresponding to or shorter than the distance between the pair of back-pressure chambers.

The scroll compressor may further include a sealing member disposed between the orbiting scroll and the main frame and installed in the back-pressure chamber. The sealing member may include a contactor disposed between the orbiting head plate and the back-pressure chamber to come into close contact with the orbiting head plate, and a supporter at least partially inserted into the back-pressure chamber and connected with the contactor.

The supporter may be formed on a surface configured to expand in a direction that connects the orbiting head plate and the back-pressure chamber. The contactor may form a surface in parallel with the orbiting head plate and may connect the orbiting head plate and the supporter.

A scroll compressor according to embodiments disclosed herein may not necessarily be scaled up due to a component in relation to formation of a back pressure and a component in relation to prevention of a self-rotation of an orbiting scroll, thereby making it possible to provide a scroll compressor having a compact size and excellent performance. In the scroll compressor, an orbiting wrap and a guide groove may be formed together on one surface of the orbiting scroll, and a fixed wrap and an installation groove may be formed at a position where they are viewed together in one direction, thereby making it possible to process the orbiting wrap and the guide groove together and to process the fixed wrap and the installation groove together. Accordingly, the guide groove and the installation groove may be precisely processed in accordance with their set position and shape, thereby making it possible to improve accuracy for an alignment of compression.

In the scroll compressor according to embodiments disclosed herein, the orbiting wrap and the guide groove may be processed together and the fixed wrap and the installation groove may be processed together, thereby making it possible to lower a level of difficulty in processing the fixed scroll and the orbiting scroll, reducing a number of operations required for manufacturing the same and manufacturing costs of the same. Further, in the scroll compressor according to embodiments disclosed herein, a back-pressure chamber may be formed on a main frame rather than the orbiting scroll, thereby making it possible to reduce the possibility of a tilt of the orbiting scroll and vibration and noise caused by the tilt, unlike a back-pressure chamber formed at an orbiting scroll. Furthermore, in the scroll compressor according to embodiments disclosed herein, a sealing member may be fixed to neither of the orbiting scroll and the main frame, and may perform a sealing function using a back pressure formed in the back-pressure chamber, thereby making it possible to significantly lower a level of wear on the sealing member.

Embodiments have been described with reference to embodiments illustrated in the drawings. However, the embodiments are provided only as examples. It will be apparent to one having ordinary skill in the art that the embodiments are intended to cover various modifications and equivalents of the disclosure. Thus, the technical scope should be defined according to the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having a sealed inner space, a fixed scroll disposed in the inner space of the casing;

an orbiting scroll coupled to the fixed scroll to form a compression chamber and configured to orbit with respect to the fixed scroll; and a main frame configured to support the orbiting scroll, wherein the orbiting scroll comprises:

an orbiting wrap engaged with the fixed scroll to form the compression chamber; and an orbiting head plate disposed between the orbiting wrap and the main frame, wherein the orbiting scroll is provided with at least one guide groove and the fixed scroll is provided with at least one self-rotation prevention member which is inserted into the at least one guide groove such that the at least one self-rotation prevention member revolves in the at least one guide groove, wherein the fixed scroll includes a fixed wrap engaged with the orbiting wrap to form the compression chamber and a fixed head plate from which the fixed wrap protrudes, wherein the fixed wrap protrudes from the fixed head plate towards the orbiting head plate, wherein the at least one self-rotation prevention member protrudes in a same direction as a direction in which the fixed wrap protrudes, wherein the orbiting wrap protrudes from the orbiting head plate towards the fixed head plate, wherein the at least one guide groove is formed on a same surface of the orbiting head plate on which the orbiting wrap is formed and is disposed to face the at least one self-rotation prevention member, wherein the at least one guide groove is disposed between the orbiting wrap and an outer circumferential surface of the orbiting head plate, wherein the at least one self-rotation prevention member is disposed at a position at which at least a portion of the at least one self-rotation prevention member is inserted into the at least one guide groove while disposed between the fixed wrap and an outer circumferential surface of the fixed head plate, wherein at least one back-pressure chamber that communicates with the compression chamber is formed at a side of the main frame, which faces the orbiting scroll, wherein the main frame comprises an orbiting scroll supporter disposed to face a surface of the orbiting head plate and configured to support the orbiting scroll and a drive shaft supporter disposed at a center of the orbiting scroll supporter in a radial direction, wherein the at least one back-pressure chamber is concave and is formed at the orbiting scroll supporter, wherein the scroll compressor further comprises a sealing member disposed between the orbiting scroll and the main frame and installed at the at least one back-pressure chamber, wherein the sealing member comprises:

a contactor disposed between the orbiting head plate and the at least one back-pressure chamber to come into contact with a surface of the orbiting head plate; and a supporter at least partially inserted into the at least one back-pressure chamber and connected to the contactor, wherein the supporter is a surface that extends in a direction that connects the orbiting head plate and the at least one back-pressure chamber, and the contactor is a surface that extends in parallel with the surface of the orbiting head plate and connects with the supporter, and wherein the sealing member is disposed in the at least one back-pressure chamber so as to move to a position in which the contactor is not in contact with the orbiting head plate and to a position in which the contactor is in contact with the orbiting head plate.

2. The scroll compressor of claim 1, wherein the at least one guide groove is concave.

3. The scroll compressor of claim 2, wherein at least one guide groove comprises a plurality of guide grooves spaced a predetermined distance apart along a circumferential direction of the orbiting head plate, and wherein a plurality of self-rotation prevention members is spaced a same distance apart as the plurality of guide grooves in the same direction as the plurality of guide grooves.

4. The scroll compressor of claim 3, wherein the plurality of guide grooves comprises four to six guide grooves disposed at the orbiting head plate, and wherein a same number of self-rotation prevention members as the guide grooves is installed at the fixed scroll.

5. The scroll compressor of claim 2, wherein the orbiting wrap is disposed between a center of the orbiting head plate and the outer circumferential surface of the orbiting head plate in a radial direction thereof while protruding from the orbiting head plate.

6. The scroll compressor of claim 2, where at least one concave installation groove is formed on the fixed scroll, and wherein at least a portion of the at least one self-rotation prevention member is coupled to the at least one installation groove to protrude towards the at least one guide groove.

7. The scroll compressor of claim 6, wherein the at least one installation groove is formed on a surface of the fixed scroll that faces the orbiting head plate.

8. The scroll compressor of claim 6, wherein the at least one self-rotation prevention member has a length longer than a depth of the at least one installation groove and shorter than a distance between mutually facing bottoms of the at least one guide groove and the at least one installation groove.

9. The scroll compressor of claim 2, wherein the at least one self-rotation prevention member has a pin shape having a predetermined diameter, and wherein the at least one guide groove is a circular groove having a diameter larger than the diameter of the at least one self-rotation prevention member.

10. The scroll compressor of claim 9, wherein the scroll compressor further comprises a ring inserted into the at least one guide groove, and wherein the at least one self-rotation prevention member revolves in the ring in contact with an inner circumferential surface of the ring.

11. The scroll compressor of claim 1, wherein the at least one back-pressure chamber is formed on a surface of the orbiting scroll supporter, which faces the orbiting head plate, is concave in a direction away from the orbiting head plate, and is formed as a ring that surrounds a center of the orbiting scroll supporter in a radial direction thereof.

12. The scroll compressor of claim 1, wherein the at least one back-pressure chamber comprises a pair of back-pressure chambers disposed in a concentric circle shape.

* * * * *